United States Patent [19]

Cutler

[11] 4,008,975

[45] Feb. 22, 1977

[54] APPARATUS FOR CONVEYING ASPHALT CONCRETE MIXTURES

[75] Inventor: Earl F. Cutler, Lawrence, Kans.

[73] Assignee: Cutler Repaving Associates Incorporated, Lawrence, Kans.

[22] Filed: Oct. 28, 1975

[21] Appl. No.: 626,360

[52] U.S. Cl. ..... 404/101; 198/727

[51] Int. Cl.[2] ..... E01C 19/12

[58] Field of Search ..... 404/101, 105, 110; 198/168, 172

[56] References Cited

UNITED STATES PATENTS

| | | | |
|---|---|---|---|
| 2,170,934 | 8/1939 | White | 198/168 |
| 2,589,256 | 3/1952 | Horning | 404/101 X |
| 2,930,477 | 3/1960 | Schrader | 198/168 |
| 3,228,311 | 1/1966 | Mengel | 404/101 |
| 3,361,042 | 1/1968 | Cutler | 404/101 X |
| 3,693,512 | 9/1972 | Smith | 404/101 |
| R25,275 | 10/1962 | Pollitz | 404/84 |

*Primary Examiner*—Nile C. Byers, Jr.
*Attorney, Agent, or Firm*—Olson, Trexler, Wolters, Bushnell & Fosse, Ltd.

[57] ABSTRACT

Disclosed is apparatus for conveying asphalt concrete materials from a loading station to a dispensing section of a road resurfacing machine. The conveying apparatus is provided with a loading area for receiving asphalt concrete mixtures and conveying the mixtures first in one direction for a short distance over a fixed platform from which it falls to a trough where the mixtures ae moved in the opposite direction along the bottom of the trough by a lower conveyor flight comprising a plurality of spaced apart bar elements associated with the conveyor.

2 Claims, 4 Drawing Figures

APPARATUS FOR CONVEYING ASPHALT CONCRETE MIXTURES

BACKGROUND OF THE INVENTION

This invention relates generally to roadway resurfacing apparatus, and more particularly to a new and improved asphalt concrete conveyor arrangement for such road resurfacing apparatus. This invention deals with substantial improvements in handling of asphalt concrete mixtures during road repaving operations.

Road resurfacing apparatus, in general, is set forth in my earlier filed U.S. Pat. No. 3,361,042 which discloses means for quickly and inexpensively resurfacing roadways made of asphalt concrete material and the like. The apparatus may be from 8 to 12 feet wide and from forty to fifty feet long and move along the roadway at a slow rate of speed so that during a single continuous pass over the pavement, the old road surface in front of the machine is excavated and converted into a refinished road surface at the rear of the machine. During the conversion of an old road to a new road, new asphalt concrete mixtures may be added to either compensate for material missing as a result of potholes in the road or to provide a road surface which is thicker than the old road surface. A distinct advantage of repaving apparatus of the type disclosed in the above-mentioned patent is that the finished repaved strip of highway is substantially immediately available for traffic after it is completed.

Briefly, the road repaving apparatus first heats the road in a non-oxidizing environment consisting substantially of radiant heat so that the heat penetrates through the asphalt concrete pavement to a depth of approximately one inch or so. This is substantially immediately followed by a scarifying operation which deeply excavates the heated asphalt material to disarrange the surface to a depth of at least the depth of heat penetration, and generally to a depth of 1 or 2 inches more. Then the loosened material is piled for maximum surface exposure so that it can be further heated by either the same or a second following heating apparatus. If it is found necessary to add a given amount of conventional tack coat material or the like to help weld the total conglomeration of mixture to the substrate from which the heated material was removed, such coating is then applied. Also, this may be followed by adding additional asphalt concrete material as required. The asphalt concrete material is received from a conveyor which originates at the front of the machine where the material is loaded into a hopper by trucks or the like. The asphalt concrete material is then conveyed along the length of the machine above and past the heating and scarifying equipment where it is delivered to a dispensing area for combining the new material with the excavated material.

Heretofore, suggested means for conveying of the additional asphalt concrete material included a continuous conveyor having a material receiving platform engaged by a plurality of spaced apart scraper bars or flights secured between parallel endless chains for moving the material therealong. A trough located beneath the platform was adapted to catch and receive material which might inadvertently fall en route to the dispensing station. The material falling into the trough would be scraped therefrom by the return flights of the conveyor and periodically the end of the conveying apparatus, where the return flights wrap around the tail shaft, would have to be cleaned of excess asphalt concrete material. Furthermore, because of the nature of the heretofore suggested conveying apparatus, the total height or thickness of the layer of conveyed material is limited, which in turn limits the amount of asphalt concrete material being delivered. If a desired volume of material was to be delivered for unit time, the speed of the conveyor had to be increased. By requiring the conveyor flights to travel at higher speeds, the abrasive nature of the asphalt concrete material would cause the conveyor to wear at a faster rate.

SUMMARY OF THE INVENTION

Accordingly, it is an object of this invention to provide a new and improved conveyor apparatus for use with asphalt concrete repaving machines, which conveyor apparatus overcomes the above-mentioned problems.

Another object of this invention is to provide a new and improved conveyor apparatus which enables large volumes of asphalt concrete material to be delivered at a relatively slow rate of speed, thereby reducing the overall abrasive wear of the conveyor equipment.

Still another object of this invention is to provide a new and improved conveyor for use with asphalt concrete material which utilizes the bottom of the conveyor trough for the scraping surface along which the asphalt concrete material is conveyed to a point of discharge onto the road.

A feature of the present invention is the utilization of the bottom run of a continuous conveyor as the primary direction of travel of the asphalt concrete mixture to be conveyed. The asphalt concrete material is delivered to the bottom run by first conveying the material a short distance in the opposite direction by the top run and dumping the asphalt concrete material to the bottom run just prior to the tail shaft of the conveyor. The asphalt concrete material is then picked up by the flights as they round the tail shaft and is scraped along the trough. Asphalt concrete material which adheres to the flights along the return run is now above the trough and when such material falls from these flights, it falls to the asphalt material being conveyed to the dispensing station rather than along a return path.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figure 1:
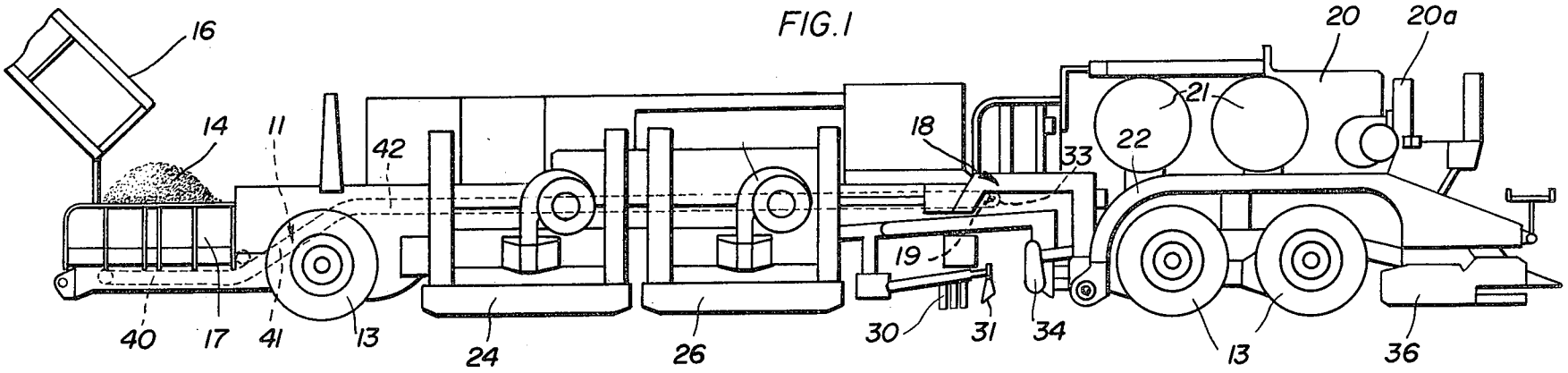
FIG. 1 is a side elevational view of a road repaving machine wherein the novel asphalt concrete conveying apparatus of this invention is utilized.

Referring now to FIG. 1, there is seen a side elevational view of a road resurfacing machine which is designated generally by reference numeral 10 and wherein the new and improved conveyor structure of this invention is utilized. The conveyor structure is designated generally by reference numeral 11 and extends from the forward end of the resurfacing machine to a dispensing station.

The road resurfacing machine 10 utilizes a plurality of large pneumatic tires or wheels 13 having sufficient contact area with the road surface so that the weight of the large machine is distributed uniformly over the road surface. Heaters 24 and 26, scarifiers 30 and cutters 31 are disposed so that as the machine moves forwardly over a road to be processed, the road surface will be heated and loosened to a depth of about one to two inches, more or less. Additional quantities of asphalt may be supplied from the conveyor 11, if desired, either to built up the road surface or simply to replace old material that has been displaced. The rate of travel of the machine over the road may be on the order of about 8 to 10 feet per minute.

The conveyor 11 extends from a loading station including a hopper or receptacle 17 at the front end of the machine rearwardly to a discharge station indicated by the reference numeral 18. An engine 20 is mounted at the rear portion of the machine and includes a control panel 20*a* located at operator station and constructed so as to control various hydraulic pumps, compressors and the like which power the various parts of the machine. Preferably the wheels 13 are driven by independent hydraulic motors operated by the hydraulic supply pumps and controlled either at the panel 20*a* or any other suitable control station. It will be understood that other drive means may be incorporated.

Fuel tanks 21 are mounted on a frame structure 22 of the machine and these fuel tanks are respectively adapted to carry fuel for the engine 20 and fuel for the radiant heater units 24 and 26. For example, one tank may be filled with diesel fuel or gasoline for the engine and another tank with propane for the radiant heaters. For a more detailed disclosure of the general aspects of the machine 10 and the manner in which it is operated, reference is made to my prior U.S. Pat. No. 3,361,042.

As indicated above, the hopper 17 is located at a loading station at the forward end of the machine and is adapted to receive a quantity of new asphalt material 14 from a truck 16 or the like. The conveyor 11 is constructed so as to extend from beneath the hopper 17 rearwardly to the discharge station 18 located so that the new material is deposited on previously heated and loosened old material on the road. Immediately following the application of the additional asphalt material, the old and new material mixture is leveled by a leveling screw 34 and then by a screed plate 36. Following the leveling, a roller may pass over the road surface for compacting in a known manner.

Figure 3:
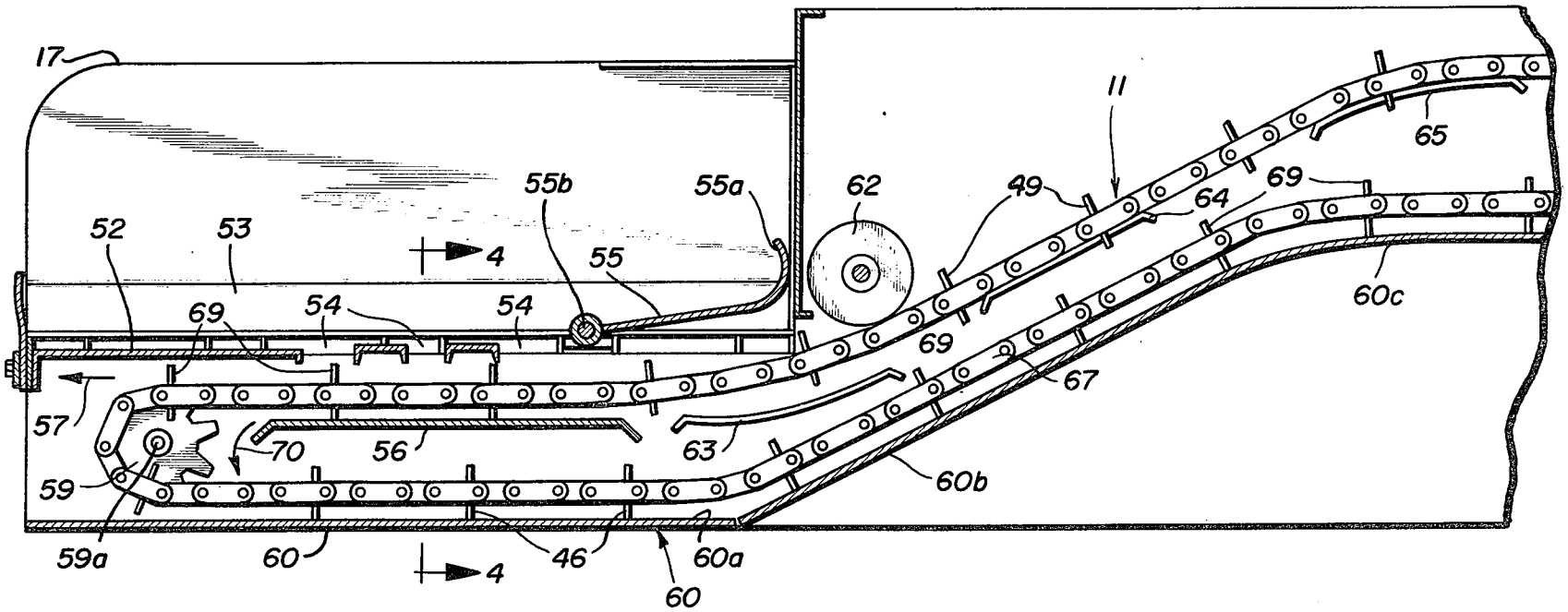
FIG. 3 is a side elevational fragmentary view of the loading area and the initial portion of the conveying apparatus constructed in accordance with the principles of this invention.
Figure 4:
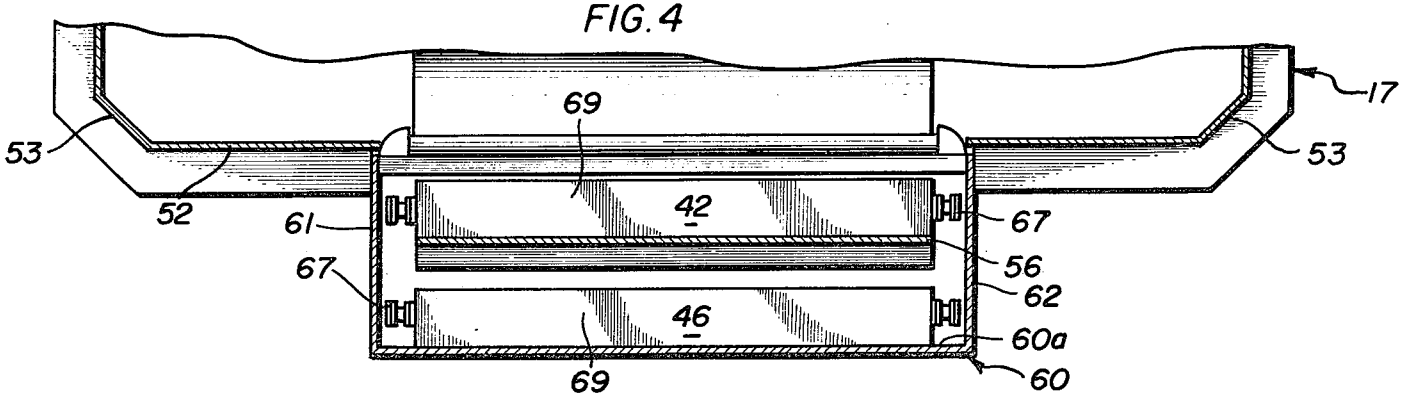
FIG. 4 is a sectional view taken along line 4—4 of FIG. 3.

As shown best in FIG. 1, the conveyor 11 includes a first generally straight and horizontal portion 40 immediately beneath the hopper portion 17 which connects with an upwardly inclined intermediate portion 41, which in turn, extends to a second straight or generally horizontal elevated portion 42. The portion 42 extends along a substantial length of the machine and terminates at the dispensing end or station 18 as indicated above. The conveyor comprises a pair of endless flexible elements or chains 66 and 67 and spaced apart scraper blades 69 extending transversely between and secured to the chains. The endless conveyor means thus provided has a top run or flight 44 which moves forwardly of the machine in a direction opposite to the direction of travel of the material to be conveyed and deposited at the station 18, and a bottom run or flight 46 which moves in the desired direction for conveying the material. The chains extend around sprockets 33 fixed on a drive shaft 19 adjacent the discharge station. A suitable hydraulic motor or other drive means is provided for driving the shaft 19. The conveyor chains also extend around sprockets 59 fixed to a tail shaft 59*a* rotatably mounted beneath the hopper 17. Guide rollers 62 are located at the lower end of an inclined conveyor portion 41 and guide plates 63, 64 and 65 are spaced along the inclined conveyor portion for engaging and guiding upper runs of the chains as shown in FIG. 3.

Figure 2:
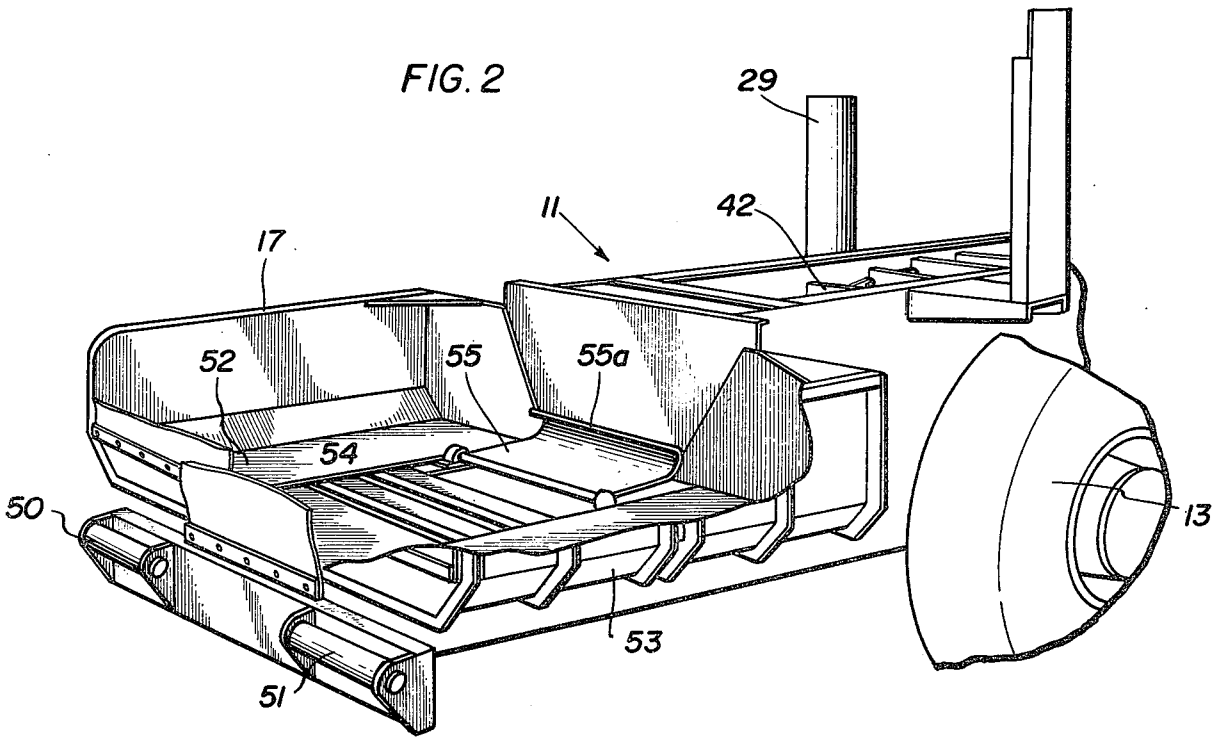
FIG. 2 is a perspective view showing the loading end of the conveying apparatus and also illustrating the two straight portions of the apparatus at different levels which are joined by an inclined portion.

As indicated above, new asphalt material may be delivered to the hopper 17 by means of a truck. Preferably, spaced apart rollers 50 and 51 are located at the forward end of the hopper 17 to act as bumpers engageable with rear wheels of the truck or other vehicle during dumping of the asphalt material into the hopper. As seen in FIG. 2, the hopper 17 has a bottom wall 52 and sloping sidewall portions 53 for directing the asphalt material to a central area of the bottom wall which is provided with spaced apart slots or openings 54. As shown best in FIG. 3, a fixed platform is mounted immediately beneath the slots or openings 54 for receiving asphalt material falling through the slots from the hopper 17. In order to facilitate moving the asphalt material through the openings 54, a plate 55 is supported for pivotal movement about a shaft 55*b*. The plate 55 has a curved upper marginal portion 55*a* for retaining asphalt for movement toward the openings. A suitable linkage, hydraulic jack-type actuator or other means, not shown, is connected between the plate 55 and the hopper or machine frame for lifting or pivoting the plate from the position shown in FIG. 3 to a generally upright position, in order to push the asphalt material into the slots 54.

A trough structure 60 extends beneath the conveyor chains from a position slightly forward of the tail shaft 59 to the discharge station 18. The trough includes sidewalls 61 and 62 and a bottom wall having a first generally horizontal portion 60*a*, an intermediate inclined portion 60*b* and a second elevated generally horizontal portion 60*c* respectively defining the bottoms of the conveyor sections 40, 41 and 42. The fixed platform or baffle 56 is located between the upper and lower flights of the conveyor so that the transverse members or scraper blades 69 on the upper flight portion of the conveyor pass over the platform. As indicated above, the transverse members 69 are spaced apart so as to, in effect, define openings therebetween which permit the asphalt material to fall from the hopper through the upper flight of the endless conveyor means and directly onto the platform 56. The conveyor is driven so that the upper flight portion of the chain moves forwardly of the machine in the direction of the arrow 57. This action causes the blades on the upper flight portion of the conveyor to slide over the fixed platform and push the asphalt material forwardly along the platform and over the forward edge thereof until the material falls onto the trough bottom 60*a*. It is noted that the forward edge of the platform 56 is located so that the material will fall into the trough in front of the tailshaft 59 and avoid interference with the tailshaft and sprockets thereon.

It is noted that the material will fall through the openings between the blades 69 on the lower flight portion of the endless conveyor to the bottom of the trough. Such material is then picked up by the lower flight scraper blades 69 and moved along the bottom trough wall portions 60*a*, 60*b*, and 60*c* to the discharge station 18 and dumped on the road.

In accordance with a novel aspect of this invention, the conveyor structure described above provides means for transporting a relatively large quantity of asphalt material within the trough structure 60 without clogging or jamming the conveyor. In view, the material is delivered to the trough by dispensing it through openings 54 to a fixed platform 56 from which it is conveyed a short distance forwardly where it is dumped onto the bottom of the trough as indicated by the curved arrow 70. The asphalt material is then picked up by the bar 69 of the bottom conveyor flight 46 and conveyed along the bottom of the trough. It will be seen that since all the material which falls to the trough bottom is discharged at the station 18, there can be no waste or accumulation of material in the conveyor which might interfere with the operation of the chains.

While a preferred embodiment of the present invention has been shown and described herein, it will be understood that variations and modifications may be made without departing from the spirit and scope of the claims.

The invention is claimed as follows:

1. In a road surfacing machine comprising a self-propelled vehicle, a conveyor apparatus on said vehicle for moving material from a loading station adjacent a front end of said vehicle rearwardly to a dispensing station comprising, a hopper at said loading station for receiving said material from a source of supply such as a truck, said hopper having opening means at the bottom thereof at a first relatively low elevation through which said material passes, a fixed platform mounted beneath said opening means and terminating at locations adjacent forward and rear margins of said opening means for receiving said material, a continuous conveyor having an upper return run passing over said platform and a lower active run passing beneath said platform, said continuous conveyor including a pair of spaced parallel endless flexible elements and a plurality of spaced apart transverse pusher bars extending between said flexible elements at spaced intervals and providing pusher members for sequentially positively advancing substantially all of the material received from the hopper in a first direction to said lower active run and then in an opposite direction to said dispensing station, an open top trough disposed beneath said continuous conveyor, said trough including a bottom wall beneath said lower active run for supporting material being moved therealong by said lower active run, said trough bottom wall including a first generally horizontal portion beneath said platform, an intermediate diagonally upwardly inclined portion extending rearwardly from said first portion to an elevation above said first mentioned elevation, and a second generally horizontal portion extending rearwardly from said intermediate portion substantially to said dispensing station, and a plurality of discrete guide elements spaced above said intermediate and second horizontal bottom portions for engaging and guiding upper runs of said endless flexible elements above material being moved by said lower active run to the dispensing station.

2. A machine, as defined in claim 1, which includes means adjacent the forward end of said vehicle for engaging a supply truck and positively positioning said supply truck with respect to the hopper for facilitating dumping a supply of said material to the hopper.

* * * * *